US009604711B2

(12) United States Patent
Hoover et al.

(10) Patent No.: US 9,604,711 B2
(45) Date of Patent: Mar. 28, 2017

(54) VEST HAVING CONTINUOUS STRAP SYSTEM

(71) Applicant: The Coleman Company, Inc., Wichita, KS (US)

(72) Inventors: Paul E Hoover, Denver, CO (US); Yiyun Culp, Wichita, KS (US); Jean E Johnson, South Haven, MN (US); Rui Luo, Wichita, KS (US); Tyler M. Winthers, Thornton, CO (US); Shannon L Morrison, Littleton, CO (US)

(73) Assignee: The Coleman Company, Inc., Witchita, KS (US)

( * ) Notice: Subject to any disclaimer, the term of this patent is extended or adjusted under 35 U.S.C. 154(b) by 0 days.

(21) Appl. No.: 14/708,508

(22) Filed: May 11, 2015

(65) Prior Publication Data

US 2016/0332710 A1 Nov. 17, 2016

(51) Int. Cl.
*B63C 9/08* (2006.01)
*B63C 9/11* (2006.01)

(52) U.S. Cl.
CPC ..... *B63C 9/11* (2013.01)

(58) Field of Classification Search
CPC ..... B63C 9/11
See application file for complete search history.

(56) References Cited

U.S. PATENT DOCUMENTS

| | | | | |
|---|---|---|---|---|
| 1,511,006 | A | 10/1924 | Prescott | |
| 4,545,773 | A | 10/1985 | Evert | |
| 4,887,987 | A | 12/1989 | Kato | |
| 4,913,589 | A | 4/1990 | Faulconer et al. | |
| 4,936,805 | A * | 6/1990 | Piatt, Jr. | A41D 13/0531 441/106 |
| 4,973,277 | A * | 11/1990 | Khanamirian | A62B 35/0006 182/3 |
| 4,990,115 | A | 2/1991 | Vorhauer et al. | |
| 5,323,942 | A | 6/1994 | Dahan | |
| 5,562,513 | A | 10/1996 | Kaiser | |
| 5,662,433 | A | 9/1997 | Seligman | |
| 6,120,213 | A | 9/2000 | Stinton | |
| 6,364,729 | B1 | 4/2002 | Khanamirian | |
| 6,421,833 | B2 | 7/2002 | Khanamirian et al. | |
| 6,582,267 | B1 | 6/2003 | Steger | |
| 6,848,959 | B2 | 2/2005 | Miller | |
| 7,052,346 | B1 * | 5/2006 | Childress | B63B 35/7906 441/106 |
| 7,182,662 | B2 | 2/2007 | O'Meara et al. | |

* cited by examiner

*Primary Examiner* — Stephen Avila

(57) ABSTRACT

A flotation vest comprising single adjustment strap for adjusting the girth or the vest as well as the length of the vest to allow for a proper fit around the wearer by adjustment of a single continuous strap.

5 Claims, 3 Drawing Sheets

VEST HAVING CONTINUOUS STRAP SYSTEM

CROSS-REFERENCES TO RELATED APPLICATIONS

None.

BACKGROUND

Personal flotation devices (PFDs) as well as general flotation aids are utilized in many outdoor sports including water-skiing, fishing, boating and the like. While not always required, many sport enthusiasts appreciate the enhanced safety provided by a flotation aid such as a flotation vest. Whether the flotation vest is certified to a certain level by the United States Coast Guard or other similar authority or not, such flotation aids are beneficial. While there are unlimited different sizes of persons who desire to use a flotation vest, most manufacturers make only certain sizes for adults such as small, medium, large, extra large and so forth. Because of the limited sizes available and the need for a snug fit of the vest, users must rely on adjustment straps and buckles located on the vest to achieve a more tailored fit. While a vest needs to be adjustable, it also needs to be easily adjustable, in a simple manner, with as few motions as possible. Conventional flotation vests have straps encircling the waist that are cinchable. Conventional flotation vests may also have separate straps on each side of the vest with buckles located at the shoulders or sides such that the user tightens each side of the vest (left and right) to achieve a better fit of the vest both from a girth standpoint and a length standpoint. What is needed is a flotation vest wherein the user need only tighten a single strap to adjust the girth and length of the vest.

BRIEF SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

A vest comprising a front member, a rear member, first and second shoulder members, first and second arm openings, and a neck opening and having a strap system for adjusting the length of the vest and the girth of the vest about the torso area of a user comprising a single continuous length of flexible material which is adjustable at one or both ends.

For a fuller understanding of the nature and advantages of the present invention, reference should be made to the ensuing detailed description and accompanying drawings.

DETAILED DESCRIPTION

In the following description, various embodiments of the present invention will be described. For purposes of explanation, specific configurations and details are set forth in order to provide a thorough understanding of the embodiments. It will also be apparent to one skilled in the art, however, that the present invention may be practiced without the specific details. Furthermore, well-known features may be omitted or simplified in order not to obscure the embodiment being described.

Figure 1:
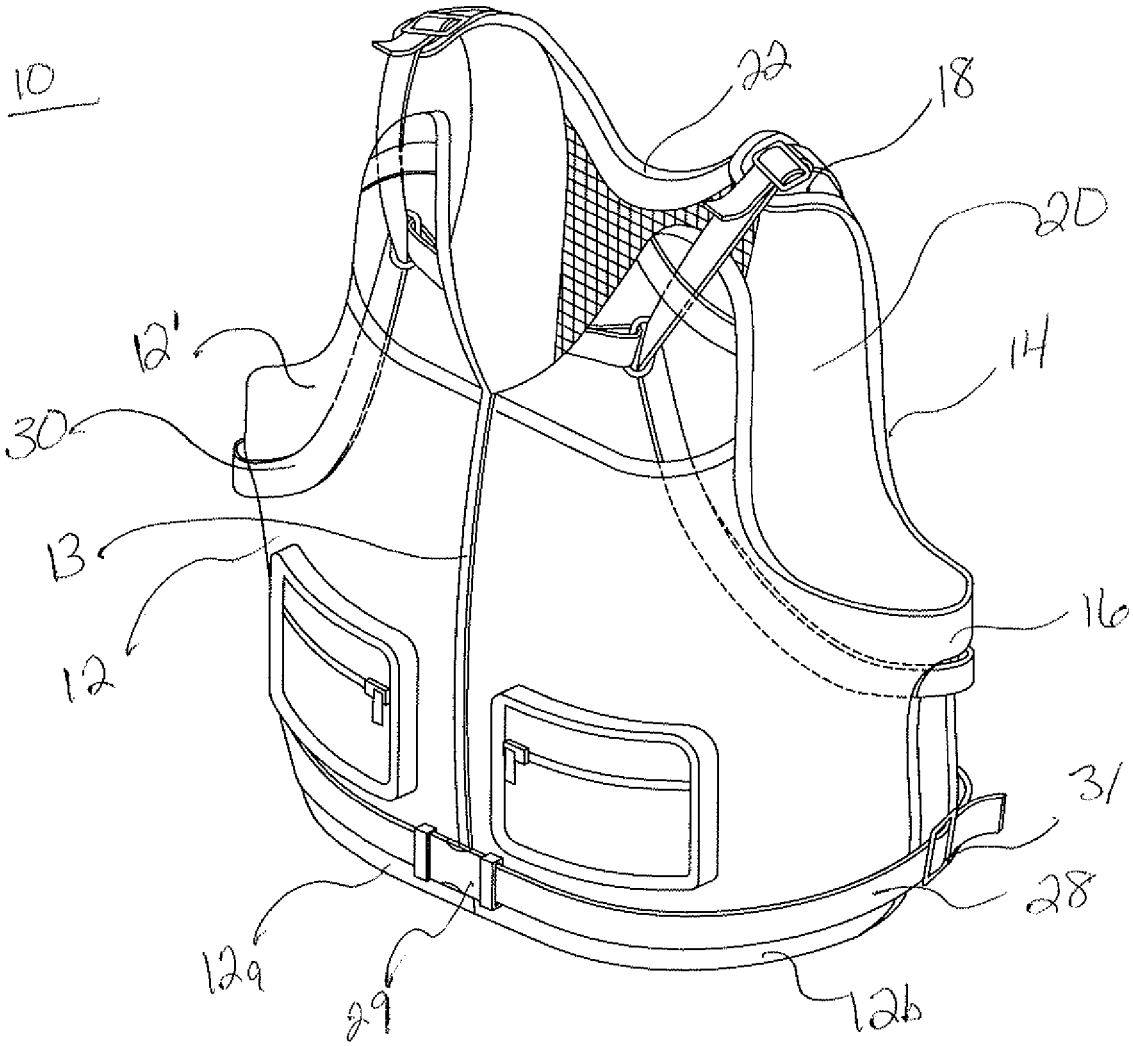
FIG. 1 shows a perspective view of a flotation vest of the present invention, with a hidden view of the continuous strap where applicable, in accordance with an embodiment.

Referring now to the drawings, in which like reference numerals represent like parts throughout the several views, FIG. 1 shows a flotation vest 10 comprising a front member 12, a rear member 14, sides 16, shoulder members 18, arm openings 20, and neck opening 22. As shown in FIG. 1, the basic construction of the vest 10 is accomplished in accordance with conventional flotation vests known in the industry wherein the front member 12 and rear member 14 are preferably connected to each other at sides 16 and shoulder members 18, defining arm openings 20 and neck opening 22 to enable the user to don the vest. As with conventional flotation vests, the outer shell of vest 10 is preferably made of neoprene, nylon or similar durable textile fabrics used with flotation or water devices. Flotation members are located in various areas on vest 10 and are retained onto vest 10 by outer shell as is known in the industry. Flotation members comprise flotation foam such as PE or PVC foam, but may also be made of other buoyant material known in the industry. Flotation members may comprise a single piece of foam or may comprise multiple pieces of foam retained within outer shell. Vest 10 may be formed of a single piece of fabric or of multiple pieces of fabric cut to a pattern and attached to each other by stitching, welding or the like as is known in the industry. Although the above structure has been disclosed, it should be understood that the specific structure of the vest may vary and still fall within the scope of the present invention. For example, although the front member 12 is shown in FIG. 1 as being a split panel 12*a*, 12*b* that is secured via a zipper 13, it is possible for other securing means to be used such as toggles and the like. It is also possible for front member 12 to comprise a single piece with no opening (not shown). Further, it is within the scope for vest 10 to have the opening on a side 16 with an appropriate closure mechanism (not shown), or even to comprise no openings other than the arm openings 20 and neck opening 22, as is also known in the industry. The specific construction of the vest shape and materials is not the focus of the present invention.

Figure 2:
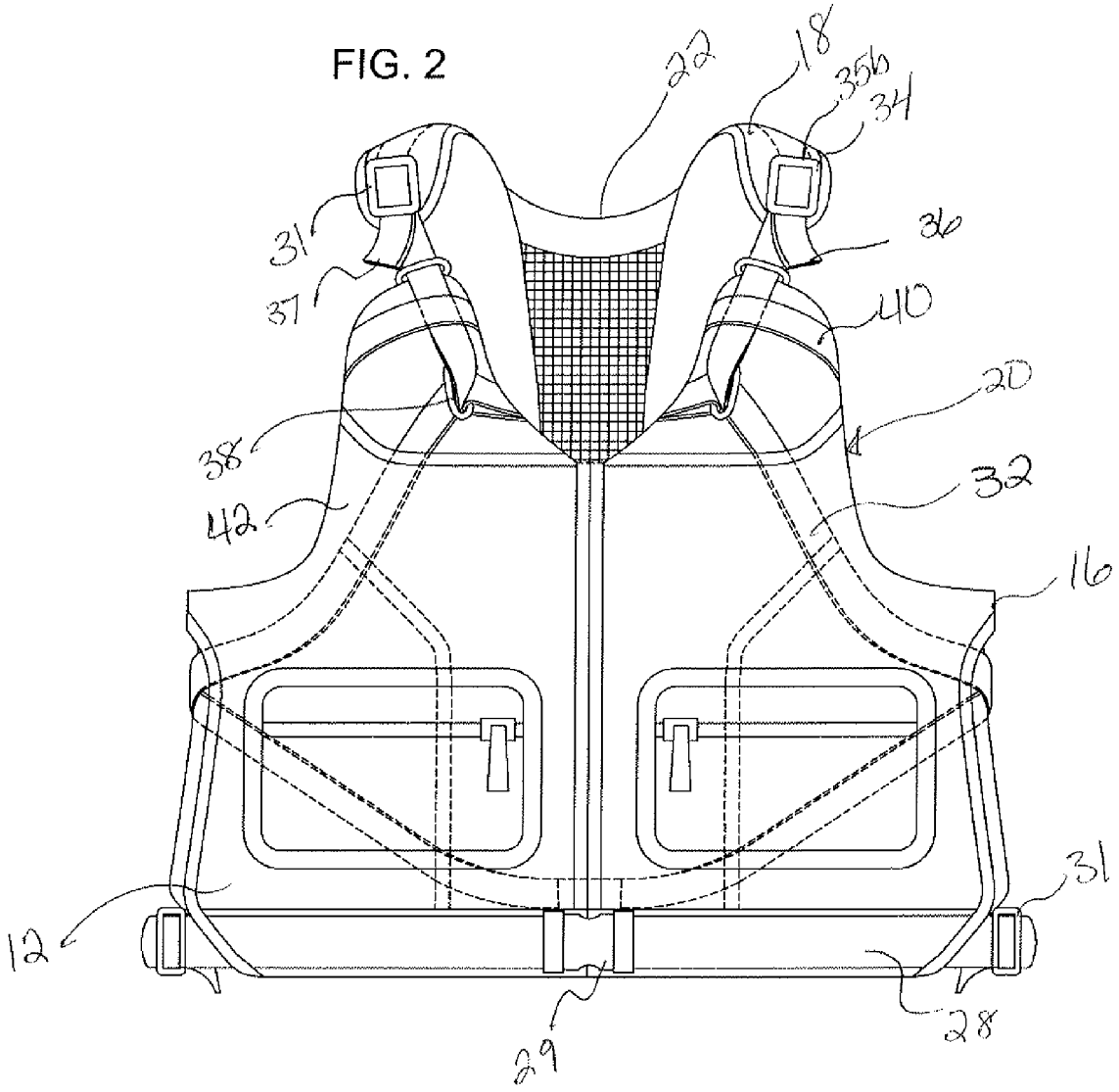
FIG. 2 shows a front view of the vest of FIG. 1, with a full hidden view of the continuous strap.
Figure 3:
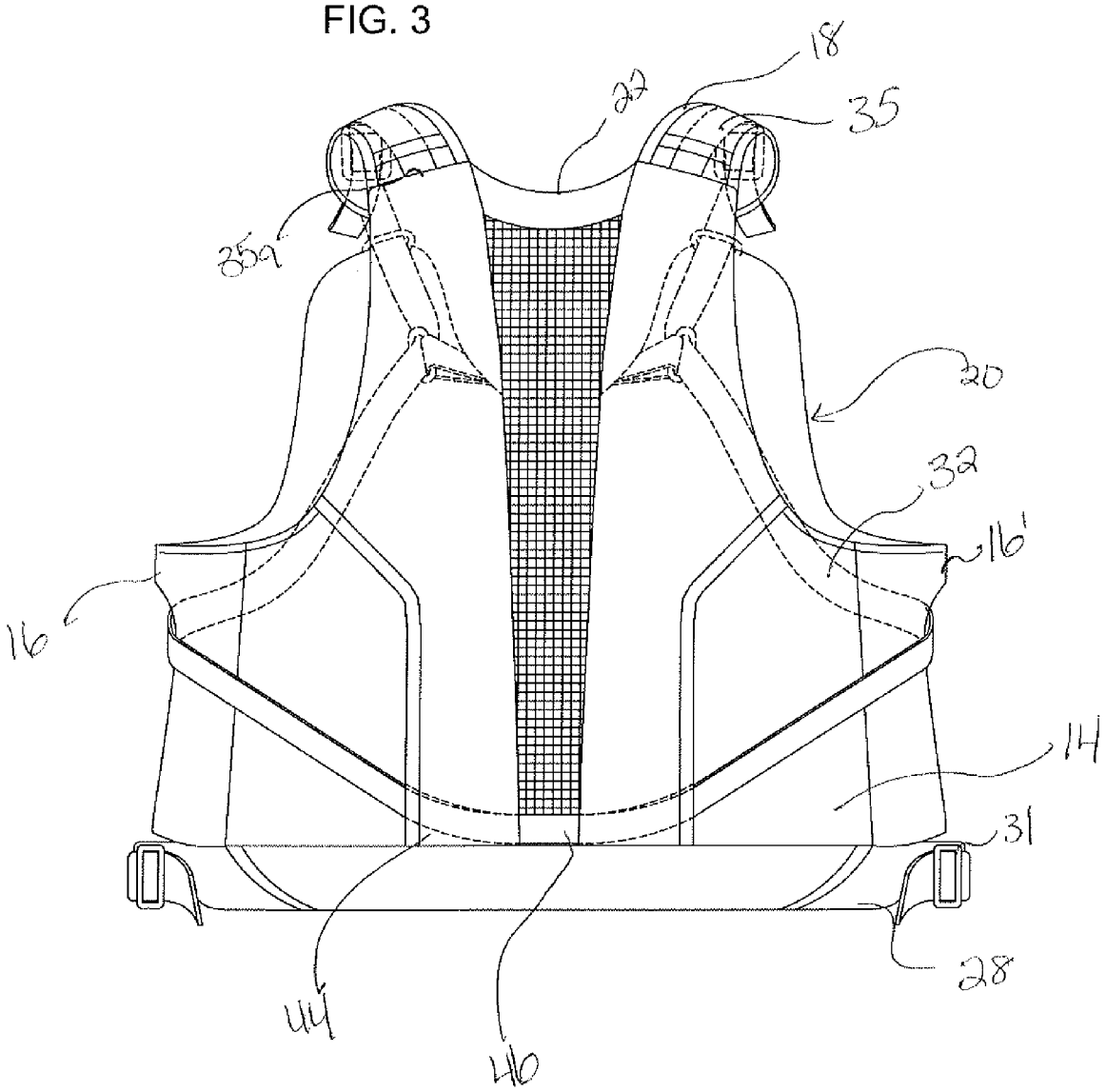
FIG. 3 shows a rear view of the vest of FIG. 1, with a full hidden view of the continuous strap.

As with conventional vests, flotation vest 10 comprises waist strap 28 as shown in FIGS. 1-3 which encircles the waist of the user and allows for adjustment of the waist strap 28 either at the front of the vest near the buckle 29 or at the sides at waist adjustment buckles 31. The type of webbing strap utilized is preferably nylon webbing strap known and commonly used in the industry although other types of material which provides a similar function could be used. Other types of adjustable mechanisms known and used in the industry, however, are also within the scope of the present invention, as would be an elastomeric strap material. Although adjustment on both sides 16 of vest 10 is depicted, it is within the scope of the invention to have no side adjustment or to only have adjustment on a single side. It is also possible for the sides 16 to be open where front member 12 and rear member 14 meet such that vest 10 can be spread apart at one or both sides 16 for ease of donning. Sides 16 could then include zippers or other closure means commonly used in the industry.

In accordance with a first embodiment, vest 10 comprises continuous strap system 30. Continuous strap system 30 further comprises a single adjustment strap 32, shoulder buckles 34 and shoulder strap anchors 35. As shown in FIGS. 2-3, a first end 35*a* of each shoulder strap anchor 35 is secured to rear member 14 at or near the top of each shoulder member 18, respectively. Shoulder strap anchors 35 are preferably stitched to rear member 14 but may be welded or otherwise secured. The free ends 35*b* of each shoulder strap anchor are secured to each shoulder buckle 34, respectively. Although the use of shoulder strap anchors is shown for securing shoulder buckles to vest 10, it is within the scope of the present invention to use other means of securement such as directly stitching shoulder buckles 34 onto shoulder member 18 and other attachment means known in the industry.

A first end 36 of adjustment strap is secured to vest 10 at a first shoulder buckle 34. Adjustment strap 32 extends down the exterior surface of front member 12 on a first side 12*a* and passes underneath a strap retaining tab 40 located near shoulder member 18. Adjustment strap 32 passes through retaining ring 38 and under front overlay 42 such that strap passes between front member base layer 12 and front overlay 42. Strap 32 passes down first front side 12, under arm opening 20 on the same first side and passes around to the rear side 14. Next, strap 32 passes under rear overlay 44 such that strap passes between rear overlay 44 and rear member base layer 14. Rear overlay 44 is shown as having opening 46 through which strap 32 passes as it transitions from the left half of the vest to the right half of the vest (or vice-versa) but it is also within the scope of the present invention for rear overlay 44 to be continuous or to comprise a section of mesh without opening 46. Strap 32 then exits rear overlay 44 on the second half of the vest and passes around the second side 16 and up around the torso on the second front side 12*b* and up to the second shoulder member 18 where it secured to second buckle 34.

Although the use of front overlay 42 is described above, it is within the scope of the present invention for vest to instead utilize a channel or sleeve to retain strap in the desired position or to use D rings, loops, tabs or other mechanisms to retain strap in its desired position and allow strap 32 to curve around arm openings without entering the space of the arm openings 20. Similarly, rear overlay 44 may be replaced with a channel, a sleeve, loop, ring or other retaining mechanism known in the art to restrain strap 32 at or near the lower edge of the vest but still allow for movement of the strap through the retaining mechanism.

Adjustment strap 32 and shoulder strap anchors 35 are preferably lengths of nylon webbing as is known and used in the industry, although alternative materials having the same strength and functionality could be used. For additional stability, strap retaining tabs 40 may be located on shoulder member 18 to allow for passage of adjustment strap 32 underneath but to restrict movement of strap 32 away from vest 10. To adjust the size of the vest, a wearer would pull on the first end 36 and second end 37 of adjustment strap, each located near the upper shoulders to tighten the fit of the vest 10 and would lift the shoulder buckles 34 to loosen the strap 32 and thereby loosen the fit of the vest. Because adjustment strap 32 encircles the vest, the shortening of one or both ends of the strap acts to cinch the vest 10 in to a smaller size to fit tighter around the wearer. The shortening of adjustment strap 32 will serve to narrow the girth around a wearer's torso or chest area as well as to shorten the length of the vest.

As shown in FIGS. 1-3, continuous strap system 30 preferably includes two separate shoulder buckles 34, one located at the top of each shoulder member 18. Shoulder buckles 34 are preferably ladder locks that are known in the industry. It is within the scope of the present invention, however, to have only a single shoulder buckle located on one shoulder member (not shown). Other buckles and locks known and used in the industry other than those disclosed herein are also within the scope of the present invention. Although not shown, it is also within the scope of the invention for the upper attachment points to be located at points on top of the shoulder or even on the front member where the strap does not pass over the top of the user's shoulder.

It should be noted that the present invention does not require a certain level of buoyancy nor does it require a specific level of certification from any regulatory agency. More or fewer buoyant elements than those described herein may be added as desired. As noted, the buoyant elements would preferably comprise a foam or other buoyant material element encapsulated in neoprene or nylon or similar durable textile fabric which is known in the industry, although other materials having the same general functionality would also be within the scope of the invention. Additional elements for the user such as storage pockets which may be selectively closable, additional hand-warming pockets, rings, handles, drain holes, clips, bungee cords and the like may be incorporated as is known in the industry.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A flotation aid device comprising:

A vest structure comprising a front member, a rear member, first and second shoulder members, first and second arm openings, and a neck opening, said vest structure having a lower edge located near the waist of a user and configured to be worn over the torso area of a person and said vest structure comprising a buoyancy material in at least one part of said vest structure; and A strap system for adjusting the length of the vest and the girth of the vest about the torso area, the strap system comprising a single continuous length of flexible material having a first free end and a second free end, said continuous length of flexible material extending under the first aim opening at a first vertical position relative to the lower edge of the vest structure, extending around the rear member at a second vertical position relative to the lower edge of the vest structure, and extending under the second arm opening at substantially the same vertical position relative to the lower edge of the vest structure as the first arm opening.

2. A flotation aid device comprising:

A vest structure comprising a front member, a rear member, first and second shoulder members, first and second aim openings, and a neck opening, said vest structure configured to be worn over the torso area of a person and said vest structure comprising a buoyancy material in at least one part of said vest structure; and A strap system for adjusting the length of the vest and the girth of the vest about the torso area, the strap system comprising a single continuous length of flexible material having a first free end and a second free end, wherein said single continuous strap encircles said vest the first free end originating fastener located at the first shoulder member, extending downward along a first side of said front member, under said first arm opening, around to a first side of said rear member, to a second side of rear member, under said second arm opening, and extending upward along a second side of said front member, the second free end terminating at a terminating fastener located at the second shoulder member.

3. The device of claim 2, wherein said continuous strap is adjustable in length at said originating fastener to adjust the length of the vest and the girth of the vest about the torso area.

4. The device of claim 2 wherein said continuous strap is additionally adjustable in length at said terminating fastener to adjust the length of the vest and the girth of the vest about the torso area.

5. The device of claim 2 wherein said continuous length of flexible material is nylon webbing.

* * * * *